US012005288B1

(12) United States Patent
Carroll

(10) Patent No.: US 12,005,288 B1
(45) Date of Patent: Jun. 11, 2024

(54) HANDHELD ROTATOR CUFF EXERCISE AND TREATMENT DEVICE

(71) Applicant: Joint Smart LLC, Traverse City, MI (US)

(72) Inventor: Michael F. Carroll, Traverse City, MI (US)

( * ) Notice: Subject to any disclaimer, the term of this patent is extended or adjusted under 35 U.S.C. 154(b) by 37 days.

(21) Appl. No.: 17/178,906

(22) Filed: Feb. 18, 2021

Related U.S. Application Data

(60) Provisional application No. 62/979,509, filed on Feb. 21, 2020.

(51) Int. Cl.

| | |
|---|---|
| ***A63B 21/06*** | (2006.01) |
| ***A63B 21/00*** | (2006.01) |
| ***A63B 23/035*** | (2006.01) |
| ***A63B 23/12*** | (2006.01) |

(52) U.S. Cl.
CPC ..... *A63B 21/0608* (2013.01); *A63B 21/151* (2013.01); *A63B 21/4035* (2015.10); *A63B 21/4049* (2015.10); *A63B 23/03508* (2013.01); *A63B 23/1245* (2013.01)

(58) Field of Classification Search
CPC ..... A63B 21/00069; A63B 21/00072; A63B 21/00076; A63B 21/04; A63B 21/0042; A63B 21/045; A63B 21/0455; A63B 21/06; A63B 21/0608; A63B 21/0615; A63B 21/0616; A63B 21/15; A63B 21/151; A63B 21/22; A63B 21/4017; A63B 21/4019; A63B 21/4021; A63B 21/4035; A63B 21/4049; A63B 23/03508; A63B 23/1245
See application file for complete search history.

(56) References Cited

U.S. PATENT DOCUMENTS

| | | | | |
|---|---|---|---|---|
| 3,550,312 | A * | 12/1970 | East | A63B 67/10 482/44 |
| 6,551,222 | B1 * | 4/2003 | Beaver | A63B 5/20 482/82 |
| 7,329,212 | B2 | 2/2008 | Roque | |
| 7,445,585 | B2 * | 11/2008 | Domenge | A63B 21/0608 482/148 |
| 7,828,703 | B1 * | 11/2010 | Boesch | A63B 21/4049 482/93 |
| 9,254,401 | B2 * | 2/2016 | Rogers | A63B 5/20 |
| 9,381,391 | B1 * | 7/2016 | Welty, II | A63B 5/20 |
| 2003/0100418 | A1 * | 5/2003 | Domenge | A63B 21/0608 482/148 |

(Continued)

FOREIGN PATENT DOCUMENTS

| | | |
|---|---|---|
| KR | 200292454 Y | 10/2002 |
| KR | 200383644 Y | 5/2005 |

*Primary Examiner* — Zachary T Moore
(74) *Attorney, Agent, or Firm* — Mitchell Intellectual Property Law, PLLC

(57) ABSTRACT

A centrifugal exercise device for performing rotator cuff exercises. The device comprises a hand grip, a freely rotating pivot shaft extending from the upper end of the grip, and a flexible, semi-rigid cable extending through an intermediate portion of the pivot shaft at a location spaced longitudinally from the upper end of the grip. A shorter inner terminal portion of the cable extends from one side of the pivot shaft, while a longer weighted portion of the cable extends from the other side of the pivot shaft with a weighted member secured to its end.

8 Claims, 7 Drawing Sheets

(56) References Cited

U.S. PATENT DOCUMENTS

| | | | | |
|---|---|---|---|---|
| 2004/0002408 | A1* | 1/2004 | Rigas | A63B 21/0608 482/93 |
| 2005/0239614 | A1 | 10/2005 | Herder | |
| 2006/0052189 | A1 | 3/2006 | Morrison | |
| 2006/0166795 | A1* | 7/2006 | Domenge | A63B 21/06 482/110 |
| 2007/0111867 | A1* | 5/2007 | Pullaro | A63B 69/3623 482/121 |
| 2007/0135275 | A1* | 6/2007 | Oates | A63B 21/0004 482/109 |
| 2011/0282256 | A1* | 11/2011 | Carroll | A61F 5/3723 602/20 |
| 2012/0190512 | A1* | 7/2012 | Chen | A63B 21/0608 482/110 |
| 2019/0099635 | A1* | 4/2019 | Haines | A63B 21/0601 |

* cited by examiner

HANDHELD ROTATOR CUFF EXERCISE AND TREATMENT DEVICE

RELATED APPLICATIONS/PRIORITY BENEFIT CLAIM

This application claims the benefit of U.S. Provisional Application No. 62/979,509, filed November Feb. 21, 2020 by the same inventor (Carroll), the entirety of which provisional application is hereby incorporated by reference.

FIELD

The subject matter of the present application is in the field of handheld orthopedic exercise devices for treating rotator cuff injuries.

BACKGROUND

U.S. Patent Application Publication No. US2011/0282256 A1 to Carroll (the same inventor in the present application) discloses a system for treating rotator cuff shoulder problems. Part of that prior system includes a centrifugal exercise device with a weighted member on the end of a flexible connector connected to a handle. The weighted member is rotated by a handle using the ipsilateral (same side, or injured) arm. Specifically, the weighted member is spun in large circles on the end of the flexible connector by rotating the arm in a straight, unbent condition through small circles while holding the handle. The speed of rotation is performed sufficiently fast to rotate the weighted member about a circle that defines a plane substantially perpendicular to the person's straight, unbent arm. Various positions of rotation can be used, and the teachings of US2011/0282256 Carroll are hereby incorporated by reference for brevity as to further explanation.

It is believed that the more perfectly perpendicular the plane of rotation can be maintained relative to the handle axis of the exercise device, and thus relative to the straight, unbent arm of the person using the exercise device, while still requiring muscular effort to maintain and control the rotating weight in such a perpendicular plane, the better the effect on strengthening the muscle groups surrounding and supporting the rotator cuff without strain on the rotator cuff. This in turns promotes healing of any rotator cuff injury.

It is further believed that progressively changing the centrifugal force of the exercise device at various stages in the strengthening or healing process is beneficial.

BRIEF SUMMARY

The present invention is an improved centrifugal exercise device for strengthening and exercising the muscle groups surrounding and supporting the rotator cuff.

The exercise device comprises a substantially straight grip or handle with a longitudinal axis, a freely-rotating pivot shaft extending longitudinally and coaxially from an upper end of the handle a distance less than the length of the handle; a cable port extending perpendicularly through the pivot shaft at a distance spaced from the upper end of the handle less than the length of the pivot shaft; a flexible, semi-rigid cable extending through the cable port in sliding fashion, the cable having a longer or outer weighted portion extending from a first side of the pivot shaft and a shorter or inner terminal portion extending from a second opposite side of the pivot shaft; a locking member for temporarily locking the cable in the cable port such that the cable's position is fixed at a desired length ratio of the longer and shortercable portions relative to the pivot shaft; and, a weighted member secured to the outermost end of the outer weighted portion of the cable.

In one form, the ends of the cable are enlarged so that the cable is trapped in the port relative to the pivot shaft, i.e. the cable cannot slide out of the port.

In another form, the weighted member is removably attached to the outermost end of the weighted outer portion of the cable. Multiple weighted members, preferably in the form of weighted balls, are provided and can be selectively attached to and detached from the end of the cable to adjust the centrifugal force generated by spinning the weighted member in a circle around the handle axis. Alternately, the cable can be selectively unlocked in the cable port and the length ratio of the longer, outer weighted portion to the shorter, inner terminal portion extending from opposite sides of the pivot shaft can be adjusted by sliding the cable to different positions and then re-securing the cable with the locking member.

In a further form, the terminal end of the shorter, inner portion of the cable is maintained in a position spaced radially from the pivot shaft by a length of cable sufficiently long so that the terminal end extends radially beyond the end of the handle in all use positions. The terminal end of the cable may further be provided with a rigid contrasting terminal member extending radially outwardly from the terminal end in coaxial alignment with the cable axis.

These and other features and advantages of the invention will become apparent from the detailed description below, in light of the accompanying drawings.

DETAILED DESCRIPTION

Figure 1:
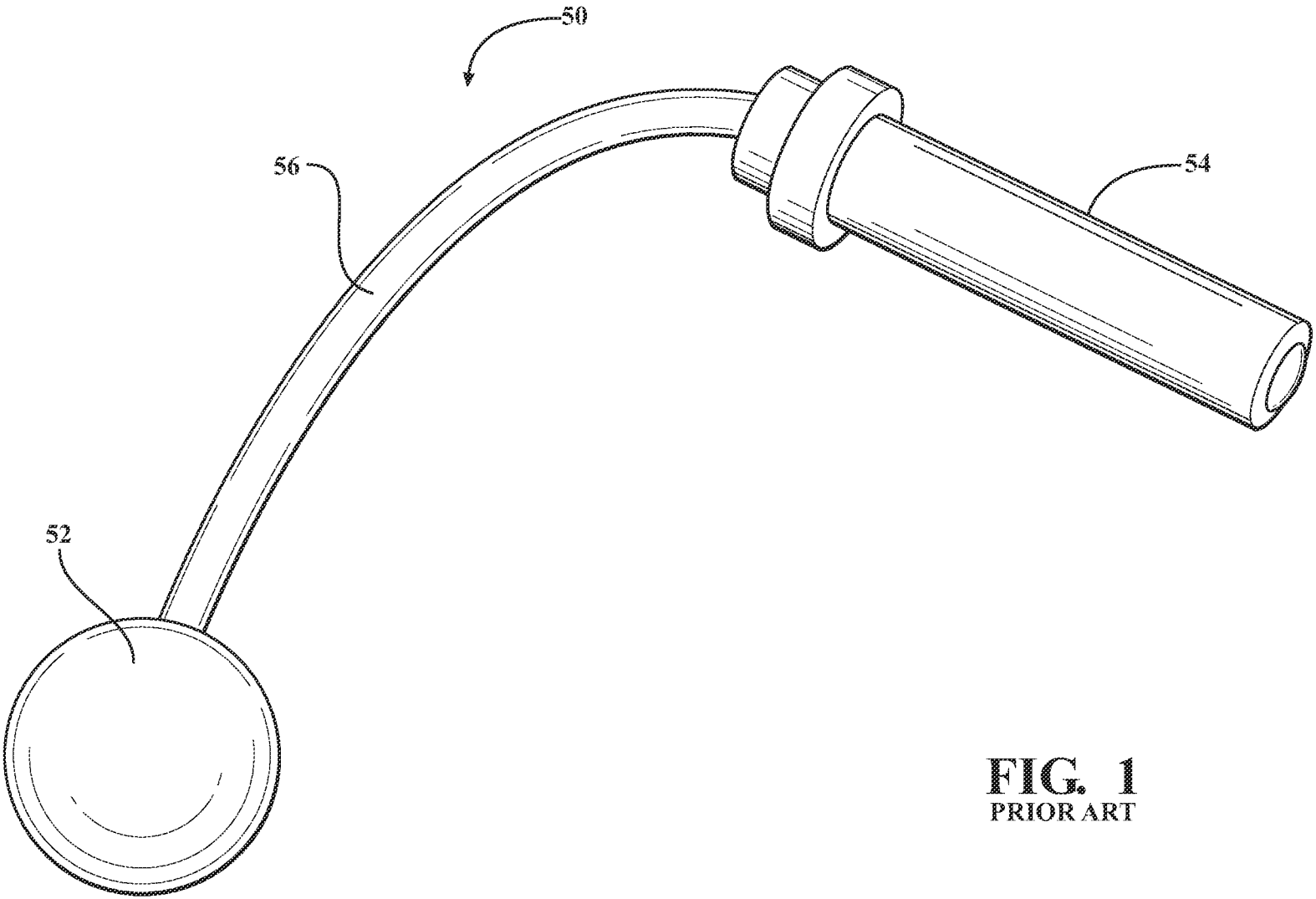
FIG. 1 PRIOR ART
FIG. 1 is a perspective view of a prior art centrifugal exercise device.

FIG. 1 shows a centrifugal exercise device 50 according to the prior art. Exercise device 50 takes the general form of a weighted member 52 rotatably connected to and spaced from a handle 54, in the illustrated embodiment by a short tether 56. Device 50 is a commercially available exercise device such as the Airope™ ropeless or "virtual" jump rope, and is described in US2011/0282256 to Carroll as cited above.

Figure 2:
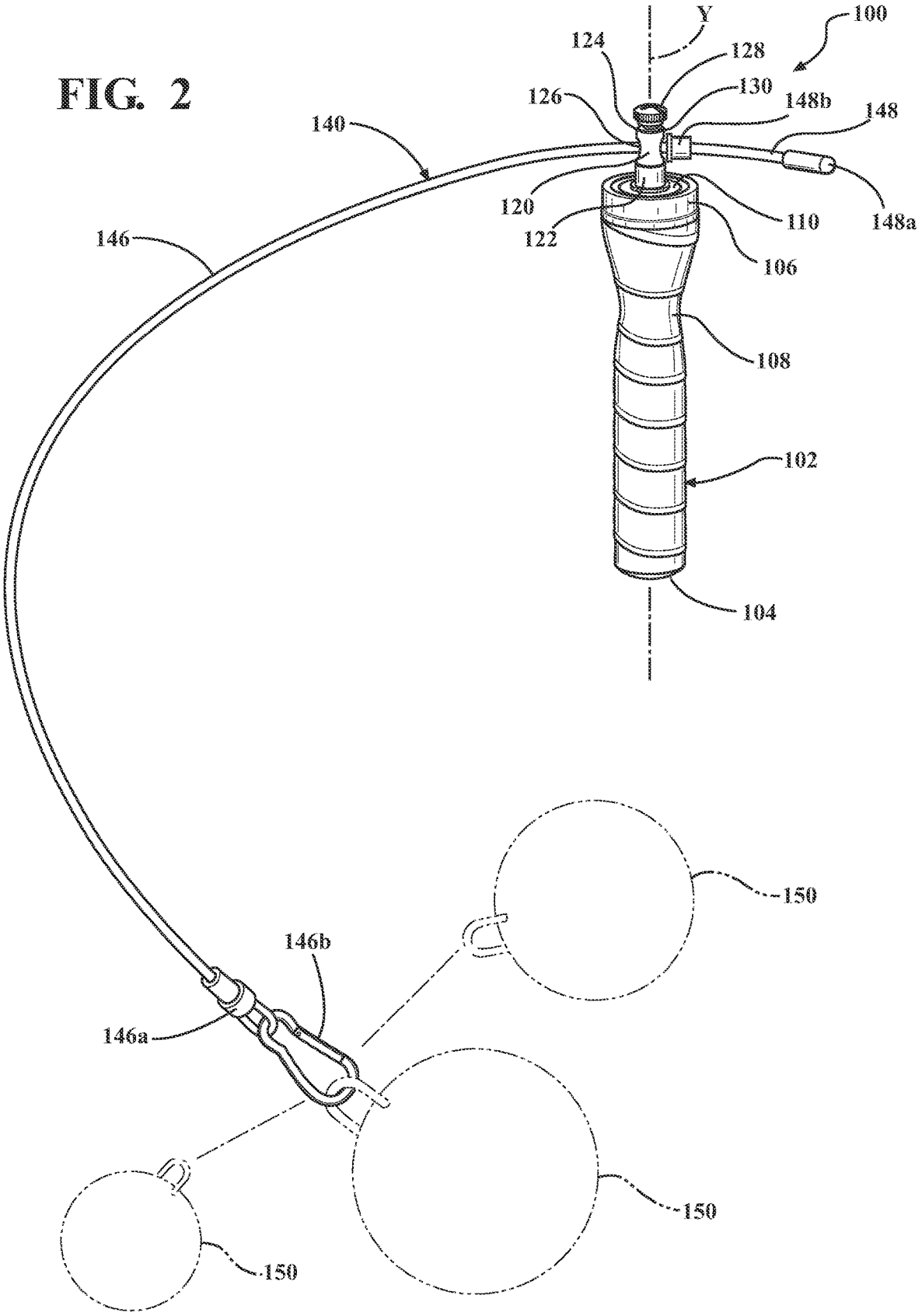
FIG. 2 is a perspective view of a centrifugal exercise device according to the present invention.

Referring to FIG. 2, a centrifugal exercise device 100 according to the invention is shown in exemplary form in order to teach how to make and use the claimed invention. Device 100 comprises a generally straight gripping handle 102 with a longitudinal axis Y running through its center. Handle 102 has a lower end 104 and an upper end 106, with an optional "waist" or narrowed diameter or width 108 near the upper end 106. The surface of handle 102 may be partially or fully covered with a friction material such as rubber or textured plastic or cloth to improve a person's grip on the handle. Handle 102 may be made of various materials, such as wood, metal, or plastic.

A pivot shaft 120 is rotatably mounted at its lower end 122 on the upper end of 106 of handle 102, for example being rotatably mounted in a bearing 110, the pivot shaft being coaxial with handle longitudinal axis Y such that the pivot shaft rotates freely and easily on the upper end 106 of handle 102. Bearing 110 is preferably flush with the upper end surface as shown in the illustrated embodiment. Pivot shaft 120 has an upper end 124 spaced from upper end 106 and bearing 110 of the handle 102, for example extending a distance on the order of one to two inches from the handle. The material for pivot shaft may vary, but in the illustrated example pivot shaft 120 is made from stainless steel, as is bearing 110.

Pivot shaft 120 includes a cable port 126 extending perpendicularly through an intermediate portion of the pivot shaft spaced above the upper end of the handle as illustrated. A cable-locking member 128 such as a stainless steel set screw is threadably secured and adjustable up and down in the upper end 124 of the pivot shaft 120 in a vertical threaded bore 130 extending from the upper end of the pivot shaft downwardly into communication with cable port 126.

A flexible, semi-rigid cable 140 passes through cable port 126 in the pivot shaft 120, with a smaller diameter than that of the cable port so that the cable 140 slides freely back and forth in the cable port unless it is secured in place with locking member 128. Cable 140 has a longer outer weighted portion 146 extending from one side of pivot shaft 120, and a shorter inner terminal portion 148 extending from the opposite side of pivot shaft 120. Cable 140 is semi-rigid in the sense that its shorter inner terminal portion 148 maintains a more-or-less perpendicular or horizontal orientation relative to the handle axis for at least a short distance from the pivot shaft 120 when device 100 is held with grip 102 in a vertical orientation, depending on the length of inner terminal portion 148 extending from the pivot shaft. The distance which the inner terminal portion 148 of cable 140 will extend before curving down significantly under its own weight will vary depending on the stiffness, diameter, and weight of the material used for cable 140.

In the illustrated example, cable 140 comprises an inner braided stainless steel core 142 surrounded by a smooth plastic sheath 144, the diameter of the illustrated cable being on the order of 2 mm (millimeters) to 3 mm (millimeters). Screwing locking member 128 down into cable port 126 causes the tip of the locking member to engage and clamp the cable 140 in position in the cable port so that the cable cannot slide back and forth, even when the cable is being spun with a weighted member on the end of the cable. It will be understood that the construction and materials used in cable 140 may vary.

Figure 3:
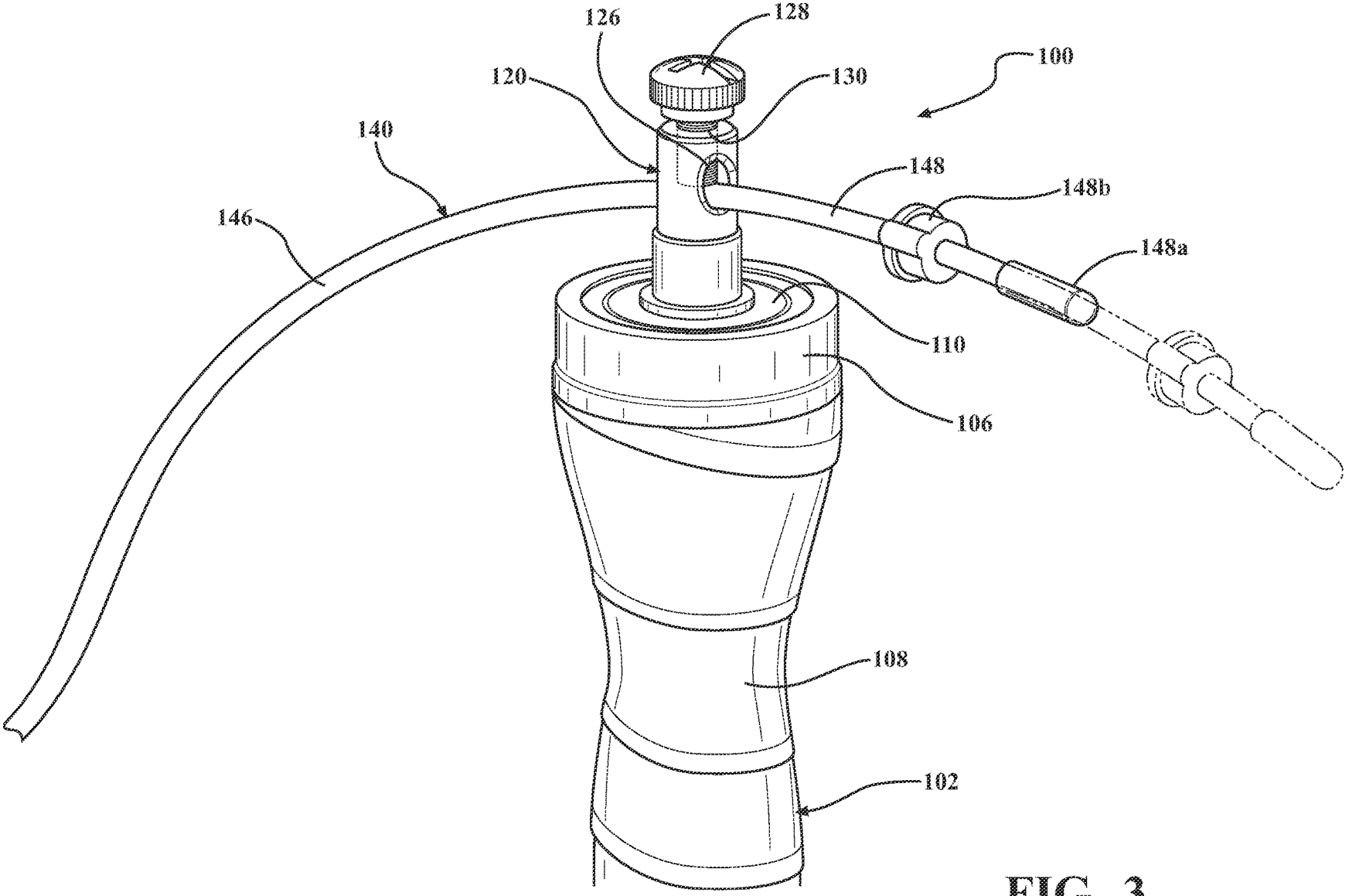
FIG. 3 is a detail of the cable and pivot-shaft end of the centrifugal exercise device of FIG. 2.
Figure 4:
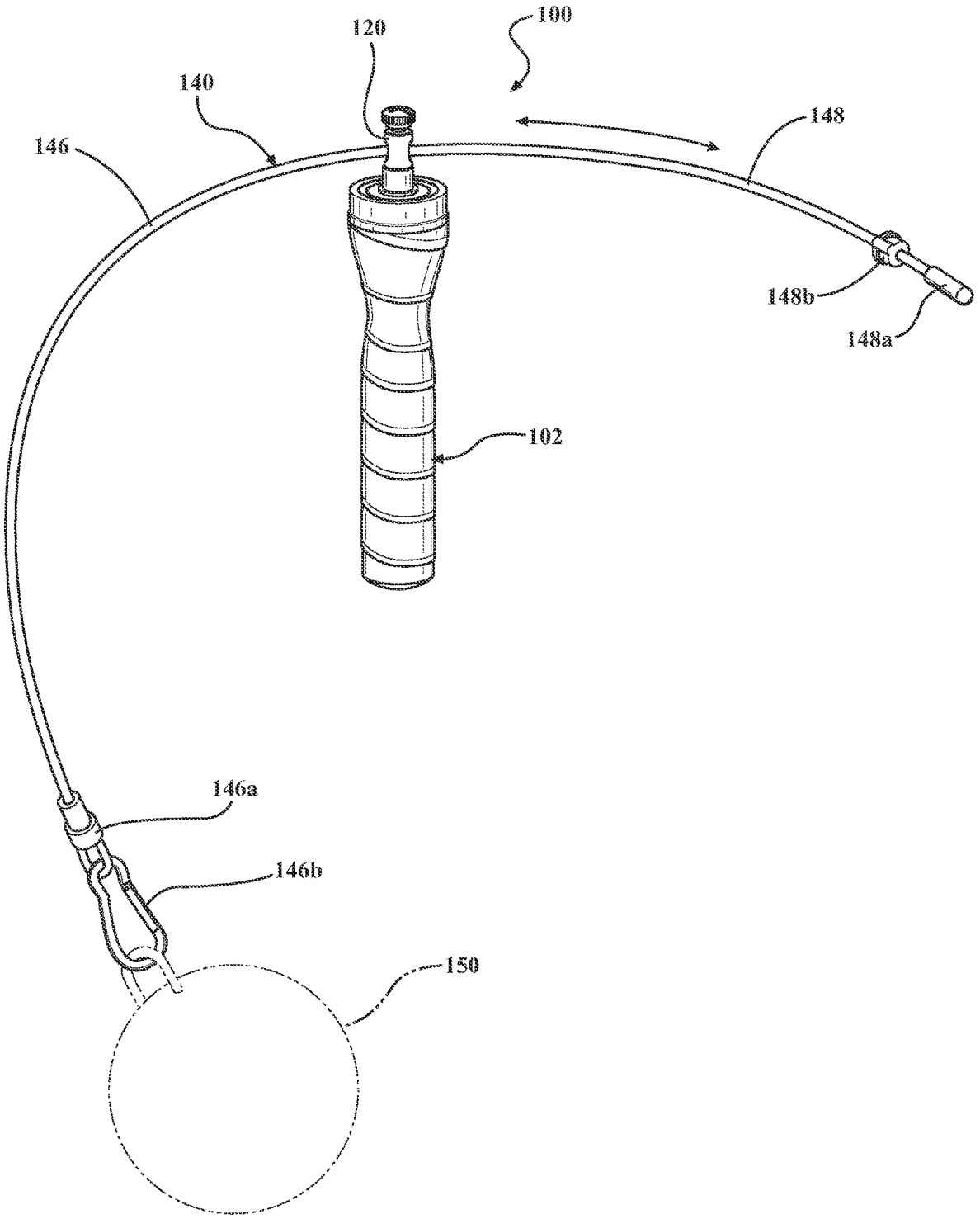
FIG. 4 is similar to FIG. 3, but shows different slide-adjusted positions of the cable portion of the exercise device of FIG. 2 relative to the pivot shaft and grip.
Figure 5:
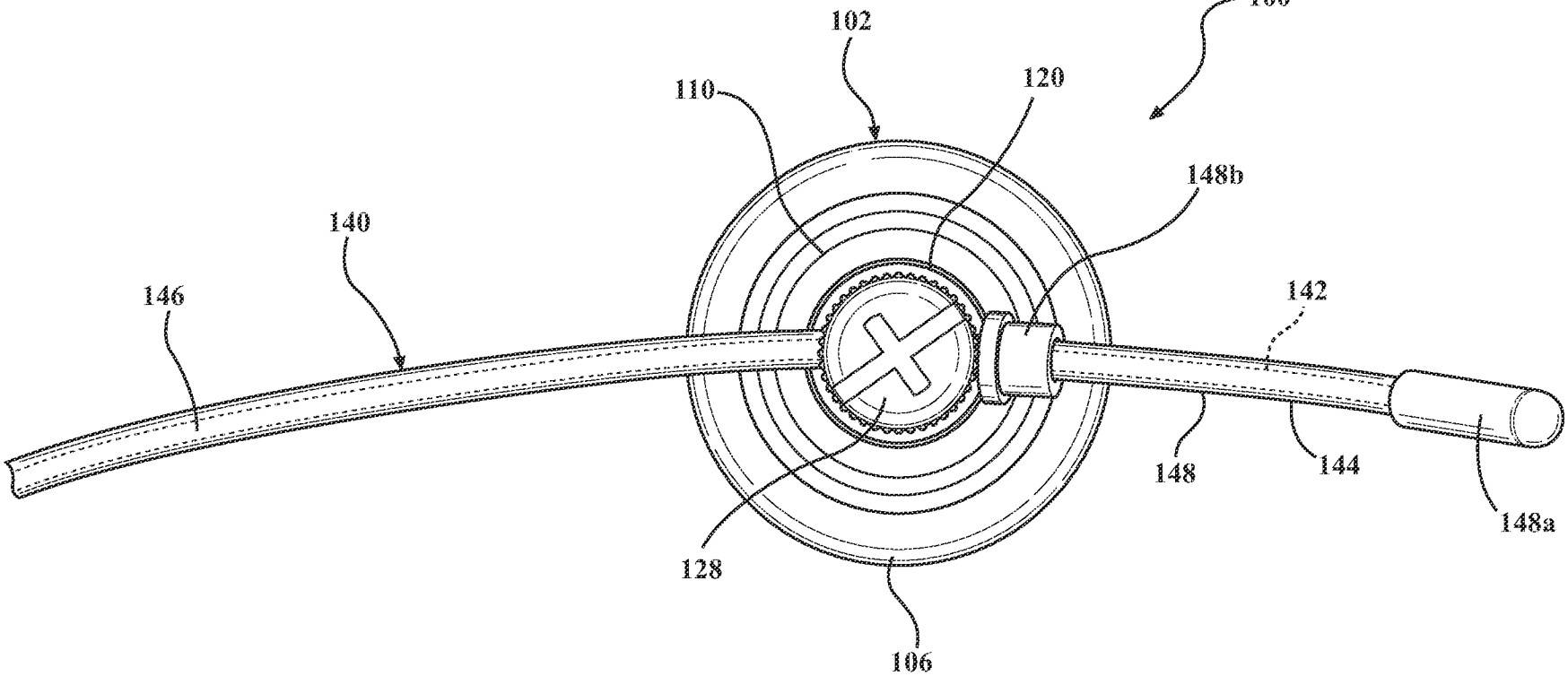
FIG. 5 is a top end perspective view of the exercise device of FIG. 2.
Figure 6:
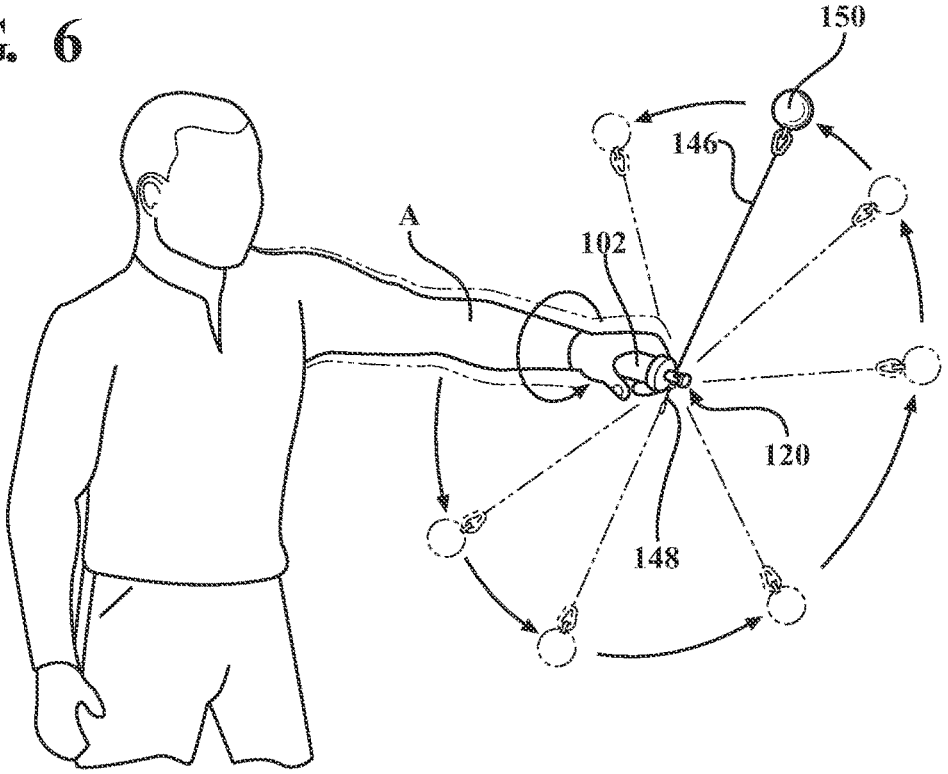
FIG. 6 is a front view of a person using the centrifugal exercise device of FIG. 2 for a front vertical plane rotation exercise.
Figure 7:
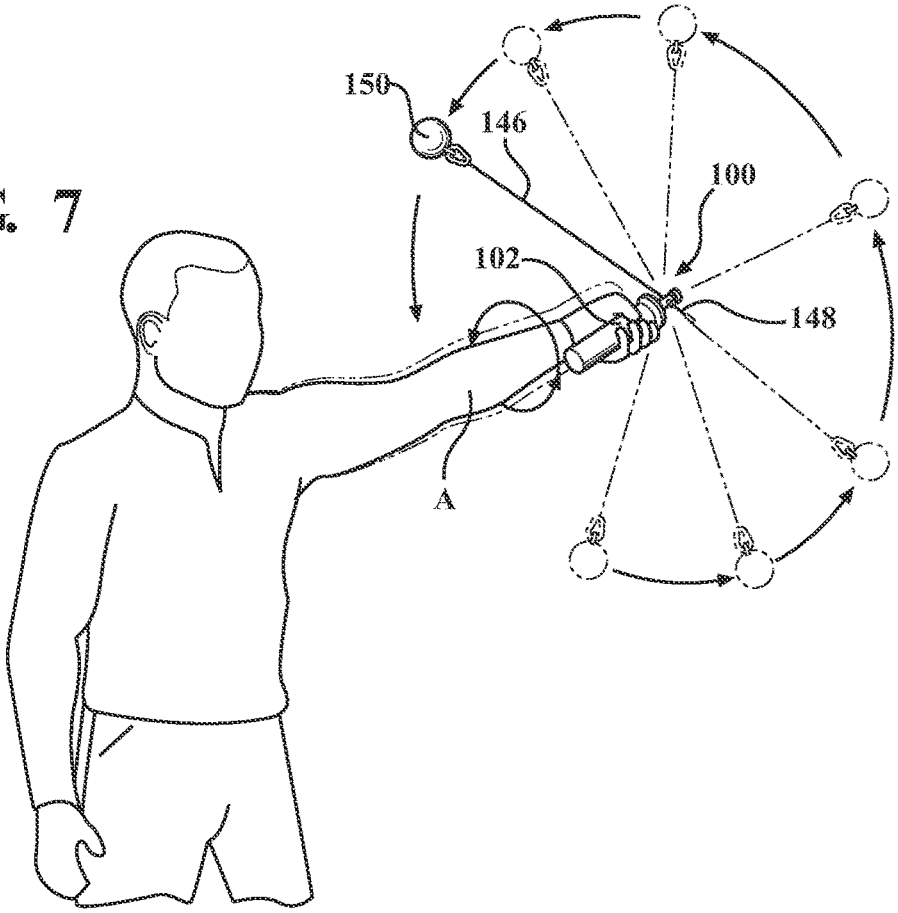
FIG. 7 is a side view of the person of FIG. 6 using the centrifugal exercise device of FIG. 2 for a side vertical plane exercise.
Figure 8:
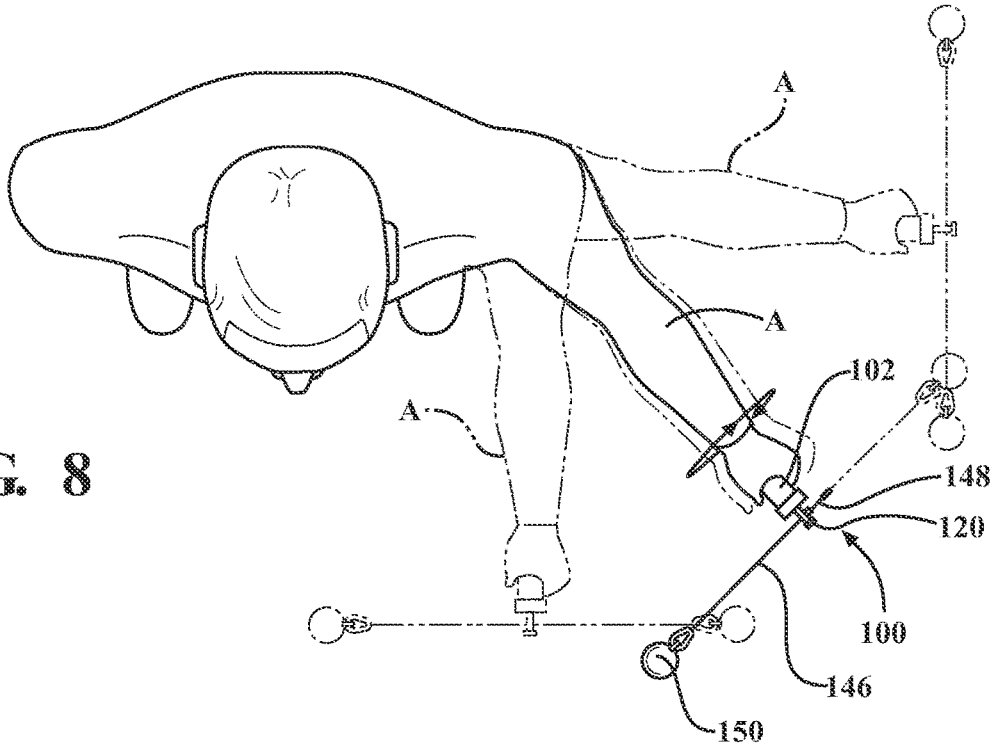
FIG. 8 is a plan view showing the person in FIG. 6 using the centrifugal exercise device of FIG. 2 for a diagonal vertical plane rotation exercise (solid lines), and also showing the front and side vertical plane rotations of FIGS. 6 and 7 (phantom lines).
Figure 9:
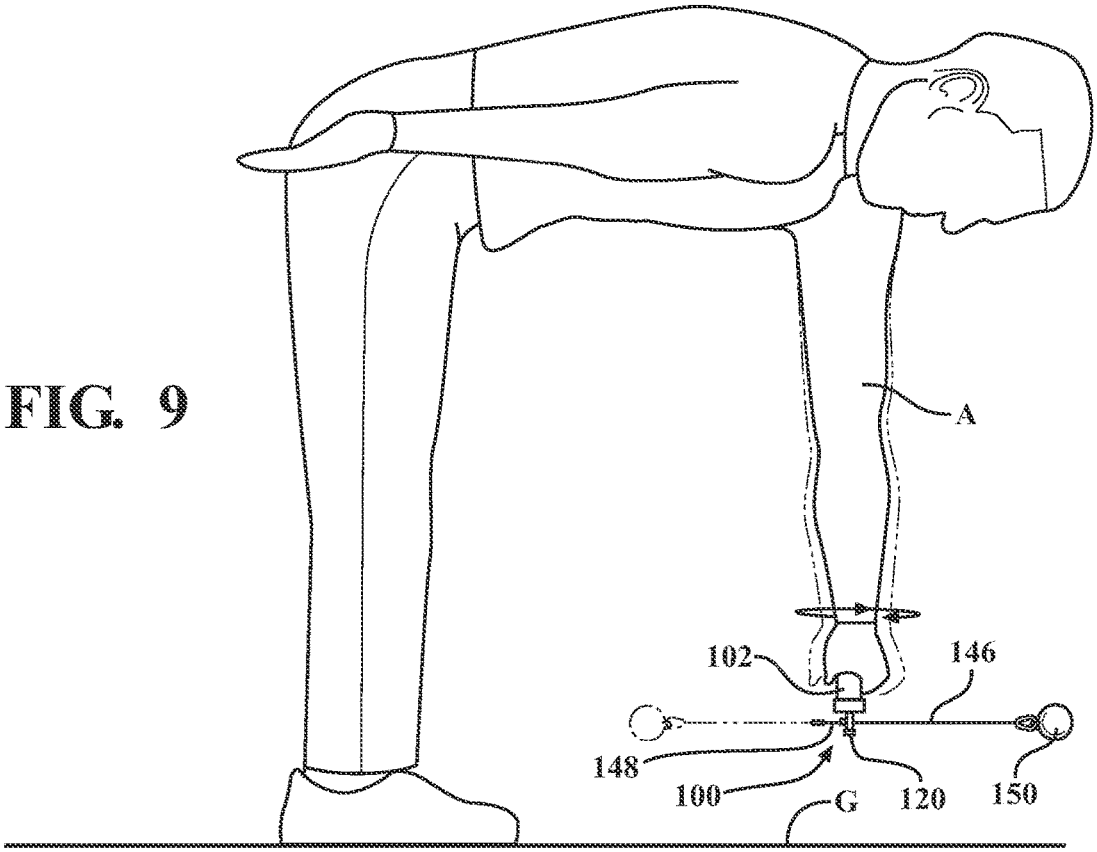
FIG. 9 is a side view of the person of FIG. 6 using the centrifugal exercise device of FIG. 2 for a downward horizontal plane rotation exercise.

The terminal end 148*a* of inner terminal portion 148 of cable 140 preferably comprises a stiffened, visually contrasting cap or tip, in the illustrated example a rubber or plastic cap or tube having a diameter greater than that of cable 140 and preferably having a color or material that visually contrasts with the cable. Terminal end 148*a* is maintained in a spaced relationship from pivot shaft 120 by an enlarged crimp or stop portion 148*b* spaced inwardly toward the pivot shaft 120 from terminal end 148*a*, in the illustrated example a metal collar crimped onto the cable at a location spaced inwardly from terminal end 148*a*. The result is that a short, relatively straight un-weighted inner portion 148 of cable 140 is always extending out generally perpendicularly from pivot shaft 120 on the side opposite the longer outer weighted portion 146 of cable 140, preferably with the terminal end 148*a* radially beyond the upper end of the handle generally as illustrated in FIG. 2. The enlarged stop portion 148*a* therefore functions to define the maximum and minimum or ideal lengths of the outer weighted and inner unweighted portions 146, 148 of cable 140 extending radially from pivot shaft 120, respectively, although the lengths may be adjusted somewhat by loosening the locking member and sliding the stop portion 148*a* outwardly as shown in FIGS. 3 and 4. The enlarged stop portion 148*a* also prevents the cable 140 from sliding completely out of the cable port 126 and off the pivot shaft should the locking member 128 loosen during use.

The longer outer weighted portion 146 of cable 140 ends at its outermost end 146*a* in a soft weighted member 150 such as, but not limited to, a dense rubber or foam-covered ball, which in the illustrated example is removably attached to a loop, clip, hook, or other mechanical connector 146*b* secured to outermost end 146*a*. As illustrated in FIG. 2, a plurality of weighted members 150 of different weights may be provided with device 100 so that a user can swap them out at the end of outer weighted portion 146 of cable 140, as needed or desired for resistance while exercising.

Description of Operation

In operation, the exercise device 100 is used by gripping handle 102 with the arm A of the shoulder having rotator cuff problems, and moving the handle in small circles with a straight, unbent arm at a sufficient speed so that the weighted member 150 on the longer outer portion 146 of cable 140 spins in large circles in a plane perpendicular to the axis Y of the handle. FIGS. 6-9 show some possible different positions in which the handle can be held relative to the user's body to selectively work different parts of the shoulder and arm, as will be understood by those skilled in the art, and as described in US2011/0282256 to Carroll cited above.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A method for treating shoulder rotator cuff problems comprising:

using a handheld centrifugal exercise device comprising:

a single hand grip handle having a longitudinal axis and a length from an upper end to a lower end sufficient to accommodate a width of an intended user's hand when gripping said hand grip handle;

a freely rotating pivot shaft extending longitudinally and coaxially from said upper end of said handle a distance less than said length of said handle;

a flexible, semi-rigid cable connected to and extending away from said pivot shaft to an outer end having a weighted member secured thereto;

said hand grip being free of encumbrances capable of interfering with said cable when said weight is being moved by a user in a circular or elliptical orbit about said upper end of said handle;

gripping said handle with an arm of the shoulder having rotator cuff problems;

moving said handle in small circles with a straight, unbent arm to rotate said weighted member around said freely rotating pivot shaft which minimizes wrist motion, at a sufficient speed that said weighted cable and said weighted member on a longer outer portion of said cable spins in large circles, exerting a centrifugal force on the shoulder having rotator cuff problems.

2. The method of claim 1 wherein said handheld centrifugal exercise device includes multiple differently weighted balls which can be selectively attached to and detached from said outermost end of said cable;

said method further including varying the centrifugal force exerted by said outer weighted member on said, affected shoulder to a level comfortable to the user by selectively attaching and detaching various ones of said differentially weighted balls until one of said balls provides the comfort level desired.

3. The method of claim 1;

wherein the step of gripping said handle with the arm of the shoulder having rotator cuff problems further includes: the user bending over and extending the straight, unbent arm downwardly and moving said handle in said small circles.

4. The method of claim 1 wherein the weighted member used is a soft weighted member.

5. A method for treating shoulder rotator cuff problems comprising:

using a handheld centrifugal exercise device comprising:

a single hand grip handle having a longitudinal axis and a length from an upper end to a lower end sufficient to accommodate a width of an intended user's hand when gripping said hand grip handle;

a freely rotating pivot shaft extending longitudinally and coaxially from said upper end of said handle a distance less than said length of said handle;

a cable port extending perpendicularly through said pivot shaft at a distance spaced from said upper end of said handle less than length of said pivot shaft;

a flexible, semi-rigid cable extending through said cable port in slidably adjustable fashion, said cable having an outer weighted portion extending from a first side of said pivot shaft to an outer end and a weighted member secured thereto, and an inner unweighted portion extending from a second opposite side of said pivot shaft to an inner unweighted end; said outer weighted portion of said cable being longer than said inner unweighted portion thereof;

a lockable and, unlockable member associated with cable port for temporarily locking said cable in cable port such that said cable's position may be varied to make said weighted portion either longer or shorter when said lockable and unlockable member is unlocked, and may be fixed at a desired length ratio of said outer weighted and inner unweighted portions of said cable relative to said pivot shaft when said lockable and unlockable member is locked;

said hand grip being free of encumbrances which might interfere with said cable when said weight is being moved by a user in a circular or elliptical orbit about said upper end of said handle;

gripping said handle with an arm of the shoulder having rotator cuff problems;

moving said handle in small circles with a straight, unbent arm to rotate said weighted cable and said weighted member around said freely rotating pivot shaft which minimizes wrist motion, at a sufficient speed that said weighted cable and said weighted member on the longer outer portion of said cable spins in large circles, exerting a centrifugal force on the shoulder having rotator cuff problems;

varying the centrifugal force exerted by said outer weighted member to a level comfortable to the user by selectively unlocking said lockable member in said cable port and pulling on said inner unweighted portion of said cable to in the direction to make the weighted portion of said cable shorter, or alternatively pulling on said weighted portion of said cable in the direction to make said weighted portion longer.

6. The method of claim 5 for treating shoulder rotator cuff problems wherein said centrifugal exercise device used comprises said inner unweighted portion of said cable including an enlarged stop portion located inwardly of said unweighted end of said inner unweighted portion of said cable to define a maximum length of said outer weighted cable portion and a minimum length of said inner unweighted cable portion.

7. The method of claim 6 for treating shoulder rotator cuff problems wherein said centrifugal exercise device used comprises: said enlarged stop portion spaces said inner unweighted end of said inner unweighted cable portion radially from said pivot shaft.

8. The method of claim 5 for treating shoulder rotator cuff problems wherein said centrifugal exercise device used comprises: said weighted member being a soft weighted member.

* * * * *